United States Patent [19]

Li

[11] 4,185,822

[45] Jan. 29, 1980

[54] RACKET AND THE LIKE

[75] Inventor: Yao T. Li, Lincoln, Mass.

[73] Assignee: Massachusetts Institute of Technology, Cambridge, Mass.

[21] Appl. No.: 875,259

[22] Filed: Feb. 6, 1978

Related U.S. Application Data

[63] Continuation-in-part of Ser. No. 695,028, Jun. 11, 1976, abandoned.

[51] Int. Cl.[2] ..... A63B 49/02; A63B 51/00

[52] U.S. Cl. ..... 273/73 C; 273/73 D; 273/73 L

[58] Field of Search ..... 273/73 R, 73 C, 73 D, 273/73 E, 73 F, 73 G, 73 H, 73 L

[56] References Cited

U.S. PATENT DOCUMENTS

| | | | |
|---|---|---|---|
| 3,814,423 | 6/1974 | Shockley et al. | 273/73 C |
| 3,843,121 | 10/1974 | Edlefsen | 273/73 L |
| 3,947,029 | 3/1976 | Gallagher | 273/73 D |
| 4,029,317 | 6/1977 | Malmstrom | 273/73 C |

FOREIGN PATENT DOCUMENTS

| | | | |
|---|---|---|---|
| 208945 | 7/1957 | Australia | 273/73 C |
| 1043897 | 11/1958 | Fed. Rep. of Germany | 273/73 D |
| 1089675 | 9/1960 | Fed. Rep. of Germany | 273/73 C |
| 2116920 | 10/1972 | Fed. Rep. of Germany | 273/73 D |
| 2725471 | 12/1977 | Fed. Rep. of Germany | 273/73 C |
| 1059989 | 11/1953 | France | 273/73 D |
| 1503812 | 10/1967 | France | 273/73 C |
| 16414 | of 1891 | United Kingdom | 273/73 D |
| 317653 | 8/1929 | United Kingdom | 273/73 C |

*Primary Examiner*—Richard J. Apley

*Attorney, Agent, or Firm*—Arthur A. Smith, Jr.; Robert Shaw

[57] ABSTRACT

A racket having a primary frame and a secondary frame, the latter being disposed within and being secured to the primary frame. The secondary frame contains the string surface of the racket and is adapted to distribute forces in such a way that the "sweet spot" of the racket is much larger than in a conventional racket of the same size. Use of a secondary frame permits manufacturing economies not permitted by the more conventional design.

17 Claims, 10 Drawing Figures

RACKET AND THE LIKE

This is a continuation-in-part of application Ser. No. 695,028 filed June 11, 1976 (now abandoned).

The present invention relates to rackets such as, for example, tennis rackets and the like.

Although the invention has relevance with respect to rackets other than tennis rackets, the explanation herein is directed mainly to tennis rackets. It is well known that maximum impulse force between a racket and a ball is achieved when the ball strikes the center portion of the string surface of the racket. Any off-center impact tends to give a player an unsatisfactory feeling and the rebound of the ball drops off rapidly as the impact region moves radially outward from the center portion, the rebound of the ball being a function of the coefficient of restitution, that is, ratio of the ball speed in to ball speed out. The area near the center of the string surface is known as the "sweet spot". One approach for providing a larger sweet spot than in standard-sized racket is to build a racket with an oversized frame, thereby increasing the sweet spot which is a percentage of the size of the string surface, but such oversized frames are awkward to use when quick maneuvering is required.

Accordingly, it is an object of the present invention to provide a racket having a frame whose cross dimensions are essentially the same as the cross dimensions of a conventional racket but having a sweet spot considerably larger than that found in a conventional racket.

Another object is to provide a racket that achieves a high coefficient of restitution.

Still another object is to provide a racket wherein impulse forces, occasioned when a ball strikes the racket string surface, are minimized to reduce torque through the racket handle to a player, thereby enhancing accuracy of return as well as reducing the possibility of tennis elbow.

Still another object is to provide a racket wherein the profile of the impulse force may be modified to improve the follow-through of the racket with the ball and thereby to improve the control of the ball.

Still another object is to provide a racket with means to change the resilience factor to suit the biological need of the player.

One significant operating cost of the racket user is that of stringing of the rackets. Furthermore, the string tension is often nonuniform, both in the original stringing and when the racket is re-strung.

A further object, therefore, is to provide a racket which presents economies in the stringing aspect of racket fabrication.

A still further object is to provide a racket that permits machine stringing.

These and still further objects are addressed hereinafter.

The foregoing objects are achieved, generally, in a racket having a primary frame with an oval-shaped interior opening and an oval-shaped secondary frame having a oval-shaped interior window, the window being smaller than the interior opening. The secondary frame is in the form of a thin planar rim and is rigid in the bending mode for moments whose axes are normal to the plane of the rim. The secondary frame is resiliently secured concentrically with respect to the interior opening of the primary frame. A plurality of strings secured in required tension by the secondary frame and disposed within said window define a string surface within said window, the string surface being disposed parallel to the plane of the planar ring.

The invention is hereinafter described with reference to the accompanying drawing in which.

Figure 1:
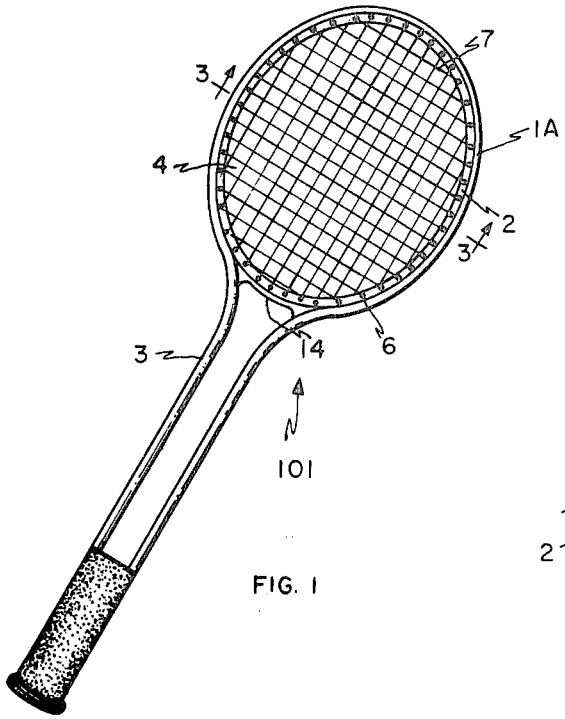
FIG. 1 is a plan view of a racket embodying the present invention concepts and having a primary frame and a secondary frame.

The present invention is multifaceted, but commonality is maintained in that all aspects thereof include use of a primary frame and a secondary frame. With reference to FIG. 1, the numeral 101 is used to designate a racket of the present invention; the primary frame is labeled 1A; and the secondary frame or inner frame is labeled 2. The primary frame is attached to a handle 3 and has an oval-shaped interior opening 4. Later reference is made to an oval-shaped interior window 5 of the secondary frame 2 in FIG. 2. The interior opening 4 and the interior window 5, of course, occupy, to a large extent, the same space, except that the opening 4 is larger in cross dimensions than the window 5; however, it is not believed that this situation will confuse anyone.

Figure 2:
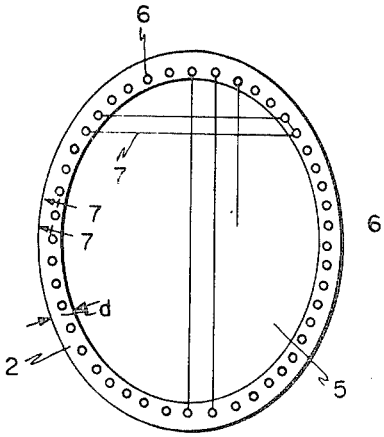
FIG. 2 is a plan view of the secondary frame only.
Figure 7:
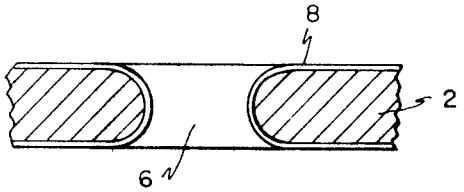
FIG. 7 is an enlarged view taken upon the line 7—7 in FIG. 2, looking in the direction of the arrows.

The secondary frame 2, as shown in FIG. 2, is typically a thin metal rim having a plurality of holes 6 or other means to secure a plurality of strings 7 in tension (~fifty-nine pounds to 80 pounds, usually), the strings being disposed within the window 5 and defining a string surface in said window. As is well known, typically, the strings are strung through the holes to provide the string surface in the form of a woven pattern. (Later there is described another way to provide such string surface.) In order that the strings 7 not be frayed, there is provided in and around each hole, as shown in FIG. 7, a thin layer of Teflon or other material 8 which removes sharp edges and reduce friction in hole area. The rim that forms the secondary frame is planar and is parallel to the string surfaces.

It will be appreciated that the planar rim is subjected to substantial inwardly-directed forces and must be sufficiently rigid to withstand such forces; said another way, the secondary frame or rim 2 must be rigid in the bending mode for moments with axes normal to the plane of the rim. The rim, however, is thin enough to be flexible along the plane of the rim so that forces orthogonal to the plane of the rim are localized.

The oval-shaped secondary frame 2 is secured concentrically with respect to the interior opening 4 of the primary frame 1A. A number of mechanisms to secure the two are shown in FIGS. 3, 4, 5 and 6; the mechanisms used in these four figures have some similarity to each other, but they differ from one another in some respects. In these figures the primary frames are marked 1A, 1B, 1C and 1D, respectively, and the secondary frame is marked 2 as before.

Figure 3:
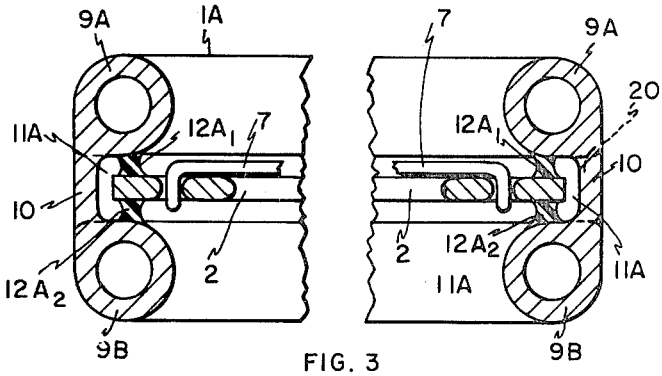
FIG. 3 is a section view taken upon the line 3—3 in FIG. 1, looking in the direction of the arrows, and shows an arrangement whereby the secondary frame is resiliently secured within the primary frame.

The primary frame 1A in FIG. 3 is formed of two members 9A and 9B that are secured together in a unitary structure by a cross member 10. The members 9A and 9B are tubular with essentially circular cross dimensions and may be made of extruded or drawn metal (e.g., aluminum, steel, or titanium). The secondary frame 2 is received within an internal channel 11A and is secured there between resilient members $12A_1$ and $12A_2$ which may be bonded within the channel 11A and may also be bonded to the secondary frame 2. Such bonding may be effected by applying heat to the resilient members $12A_1$ and $12A_2$ (which may be made of an elastomer material) or by applying an adhesive thereto. Also, the resilient members $12A_1$ and $12A_2$ exert a slight compressive force upon the rim 2 sandwiched therebetween. The channel 11A is a cavity that is open toward the interior of the frame 1A to receive the resilient members $12A_1$ and $12A_2$ and the secondary frame 2. The channel 11A extends the whole circumferential length of the frame 1A including a channeled throat piece 14 later discussed. The resilient members $12A_1$ and $12A_2$ extend the length of the internal channel 11A and the frame 2 is received in the slot between the facing members $12A_1$ and $12A_2$. Hence, the thin secondary frame 2 is resiliently secured throughout its periphery to the primary frame 1 through the compressed members $12A_1$ and $12A_2$. The members $12A_1$ and $12A_2$ can be pneumatic tubes formed of an elastomer, for example.

The combined weight of the primary frame, the secondary frame and the resilient coupling should be about the same as that of an ordinary single frame. This can be accomplished with high strength material such as composite material. Another scheme is to lighten the tip of the primary frame by providing a number of holes 20 as shown in FIG. 3. Other schemes may involve the stretching of the tip section of the primary frame or the use of chemical etching to lighten this section as those familiar with the art of fabrication well know.

The resilient members $12A_1$ and $12A_2$ serve to couple the thin secondary frame 2 securely within the interior opening 4 of the primary frame, to maintain planar stability of the secondary frame, and to transmit orthogonally directed forces upon the string surface of the primary frame, but not the principle tension forces of the strings. The tension forces are taken primarily by the secondary frame. Furthermore, the resilient coupling between the primary frame and the secondary frame, thereby provided, serves to enlarge the sweet spot of the racket, the members $12A_1$ and $12A_2$ acting as yieldable elements with a restoring force that acts, when the members are distorted upon impact between the ball and the string surface, to restore the string surface to its normal position. In effect, the resilient couplers $12A_1$ and $12A_2$ give the same physical properties, such as effective stiffness and energy storage capacity, as those provided by the string surface of an oversize racket. Some of the impact forces also act to distort the thin planar rim 2 which serves to mitigate the effect of impact; this distortion, in turn, transmits forces to the resilient couplers $12A_1$ and $12A_2$ and the couplers $12A_1$ and $12A_2$ restore the rim 2 to its original state, once the impact is removed.

Figure 4:
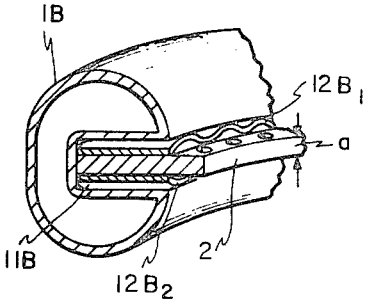
FIG. 4 is a partial section view showing another securing arrangement between a primary frame, that differs structurally somewhat from the frame of FIG. 3, and a secondary frame.

The primary frame 1B in FIG. 4 can be formed with the cross section in the form of a single enclosure with a channel 11B formed therein to receive the secondary frame which is held in place by undulating springs $12B_1$ and $12B_2$ that extend most, but not necessarily all, of the length of the channel.

Figure 5:
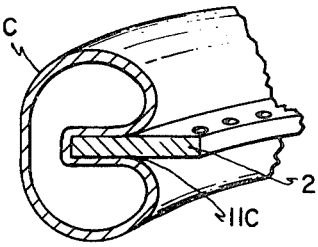
FIG. 5 is a section view, like the view of FIG. 4, but the primary frame of FIG. 5 differs structurally from the frame of FIG. 4.

The primary frame 1C in FIG. 5 is similar to that in FIG. 4 except that the channel shown at 11C is slightly narrower than the thickness a of the secondary frame 2 to receive and hold the secondary frame resiliently in place.

Figure 6:
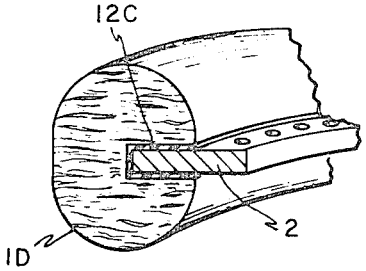
FIG. 6 is a section view, like the view in FIG. 4, but the primary frame of FIG. 6 differs structurally from the frame of FIG. 4.

In the arrangement in FIG. 6 the primary frame shown at 1D and the secondary frame 2 are constructed by a stacking wood or a composite material together, as in plywood construction. Suitable resilience may be provided in the use of the cement marked 12C or in the selection of the wood and composite material.

The primary frame 1D is made of wood or a composite material.

Figure 10:
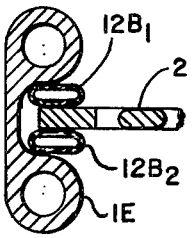
FIG. 10 is a section view, like that of FIG. 4, but the primary frame of FIG. 10 differs structurally from the frame of FIG. 4.

The primary frame labeled 1E in FIG. 10 is similar to that in FIG. 4 except that the resilient members shown at $12B_1$ and $12B_2$ are pneumatic tubes.

Figure 8:
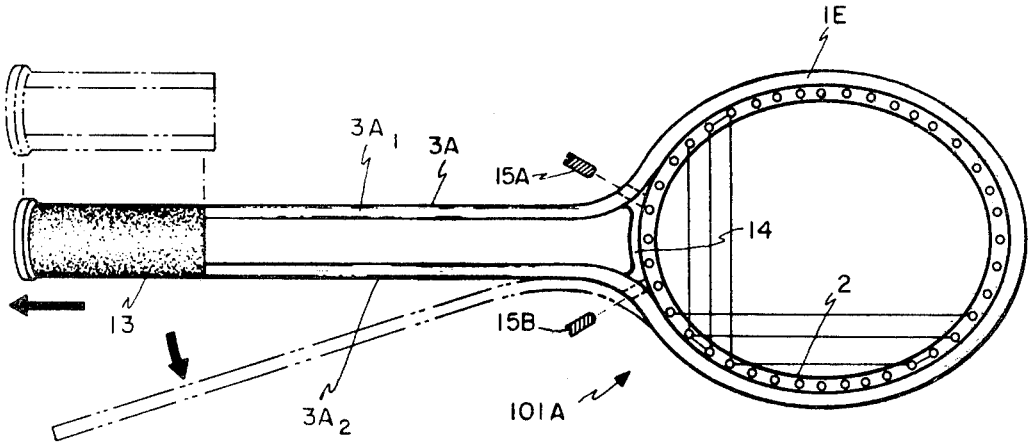
FIG. 8 is a plan view of a racket, like the racket of FIG. 1 to show a way to remove the secondary frame from the racket.

The racket shown at 101A in FIG. 8 comprises a primary frame 1E and a secondary frame 2, as before. It is shown mostly to disclose one way by which the secondary frame 2 is installed within the primary frame. To do this, the primary frame 1E is opened by removing a hand grip 13 and screws 15A and 15B to permit the two members $3A_1$ and $3A_2$ that constitute a handle 3A to spread apart, as shown dotted; at this juncture, the throat piece 14 can be removed and, then, the secondary frame 2. Once an old secondary frame 2 is removed, say, and a new frame 2 installed, the handle 3A is brought to the solid position of FIG. 8 and the screws 15A and 15B are replaced. Two appropriately positioned cavities inside the hand grip 13 maintained the two members $3A_1$ and $3A_2$ of the handle 3A in fixed relationship to one another.

The thin planar rim that constitutes the secondary frame 2, as above noted, resists inwardly-directed forces occasioned by tension of the strings. But the rim, which typically has a thickness dimension a of about 0.090" and a width dimension d of about 0.400" and is made of aluminum or magnesium or steel or titanium, for example, is not stable except as to radially inwardly directed forces; hence, it does not transmit to any large extent bending movements about an axis in the plane of the rim 2, that is, such movements are localized. Planar stability of the secondary frame 2 is maintained in the racket 101 by the primary frame; in the embodiment of FIG. 3, for example, planar stability of the rim 2 is maintained by the combination of the primary frame 1A and the rubber members $12A_1$ and $12A_2$ which serve, as well, to localize said bending movements. To maintain such planar stability at times that the secondary frame 2 is not installed within a primary frame, there is provided a bracket (not shown) to maintain planar stability of the thin frame 2.

Figure 9:
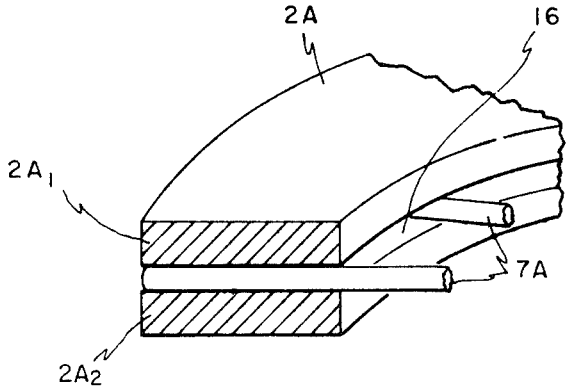
FIG. 9 is a partial section view of a modification of the secondary frame of FIG. 2.

The secondary frame 2 in FIG. 2 is strung in a somewhat conventional manner, but the frame shown at 2A in FIG. 9 is not. The frame 2A consists of two similarly-shaped rims $2A_1$ and $2A_2$ (each like the rim that forms the secondary frame 2 in FIG. 2, but about half as thick)

in the form of a sandwich structure with strings 7A that form a string surface sandwiched between the rims $2A_1$ and $2A_2$. The secondary frame 2A is formed by placing the strings 7A in tension, placing the rims $2A_1$ and $2A_2$ in their proper positions and then adhering the rims $2A_1$ and $2A_2$ together with an adhesive or the like 16. The structure in FIG. 9 lends itself to high production. The secondary frame 2A can be maintained in its required planar configuration by a bracket (not shown in the figures).

The racket herein disclosed, as above indicated, provides in a conventionally-sized racket an enlarged region having a high coefficient of restitution. Indeed, tests have shown that the racket of the present invention though of normal cross dimensions provides such high coefficient of restitution over an area of the string surface that is usually only found in rackets with oversized string surfaces. Furthermore, the present racket reduces the unsatisfactory feeling to a player, occasioned by off-center impact with a ball. Also, any such off-center impact is less likely to result in an undesired return trajectory. The metal rackets discussed above are formed by extrusion methods or drawing methods, the racket primary frame and the racket handle being formed as a single piece and the inner channel to receive the secondary frame being formed as an inner recess of the primary frame. These are tubular, thin-wall structures.

Further modifications of the invention herein described will occur to persons skilled in the art and all such modifications are deemed to be within the scope of the invention as defined by the appended claims.

What is claimed is:

1. A racket that comprises a primary frame attached to a handle and an oval-shaped interior opening, an oval-shaped secondary frame sized to fit in the interior opening of the primary frame, the secondary frame being a thin planar rim with an interior window and being rigid with respect to inwardly-directed forces in the plane of the rim, a plurality of strings secured in required tension by the secondary frame and disposed within said window to define a string surface within said window, and means coupling the secondary frame securely within the interior opening of the primary frame, to maintain planar stability of the secondary frame and to transmit orthogonally-directed forces upon the string surface to the primary frame, but not the tension forces of the strings, said tension forces being taken primarily by the secondary frame, said means coupling being a coupling system comprising elastomer means, said primary frame having an internal channel to receive the elastomer means, the peripheral edge of the planar rim that constitutes the secondary frame being securely held within the elastomer means, the plane of the rim being parallel to the string surface.

2. A racket as claimed in claim 1 in which the secondary frame is thin enough to localize forces orthogonal to the plane of the rim.

3. A racket as claimed in claim 1 in which the thickness of the thin planar rim is much less than the width dimension thereof.

4. A racket as claimed in claim 1 wherein a plurality of holes are provided in the planar rim that constitutes the secondary frame to receive the strings which are strung through the holes to provide the string surface in the form of a mesh.

5. A racket as claimed in claim 4 in which the holes have rounded edges coated with a low friction coating.

6. A racket as claimed in claim 1 wherein the elastomer means comprises at least one elastomer member that fits within the channel along the whole length of the channel and has an inwardly facing slot along said length to receive the secondary frame which is compressed within said slot in order to transmit the orthogonally-directed forces to the primary frame.

7. A racket as claimed in claim 7 wherein the elastomer member is bonded to both the primary frame and secondary frame.

8. A racket as claimed in claim 1 wherein the elastomer means comprises two facing elastomer members with a slot therebetween to receive the peripheral edge of the planar rim and to secure the planar rim within the internal channel.

9. A racket as claimed in claim 1 wherein the coupling system comprises an undulating spring member that fits within the channel and secures the secondary frame therein.

10. A racket as claimed in claim 1 wherein the elastomer means comprises an elastomer strip at each side of the thin rim, each strip extending the whole length of the internal channel and being compressed therein between the thin rim and the primary frame and being adhered to each.

11. A racket as claimed in claim 1 wherein the cross dimensions of the internal channel are just slightly less than the thickness of the secondary frame to form a slot along the length of the channel, the planar rim that constitutes the secondary frame being fitted into the slot which holds it in compression to transmit the orthogonally-directed forces to the primary frame.

12. A racket as claimed in claim 1 wherein the elastomer means comprises a pneumatic tube.

13. A racket as claimed in claim 1 in which the primary frame is a tubular, thin wall structure.

14. A racket as claimed in claim 1 wherein the secondary frame comprises two similarly-shaped closed-loop thin rims and wherein the ends of the strings that form the string surface are secured between the two rims in the form of a sandwich structure, means being provided to secure the two rims together.

15. A racket as claimed in claim 14 wherein the two rims are held together by an adhesive which maintains tension on the string and transmits said tension to the rims.

16. A racket that comprises a primary frame attached to a handle and having an interior opening and an internal channel; a secondary frame having an interior window, said window being smaller than said interior opening, the secondary frame comprising a thin planar rim and being rigid in the bending mode for moments with axes normal to the plane of the rim; a coupling system comprising elastomer means disposed within the internal channel, the outer periphery of the thin planar rim being secured within the internal channel by the elastomer means, securing the secondary frame within the interior opening of the primary frame and concentrically with respect to said interior opening; and a plurality of strings secured in required tension by the secondary frame and disposed within said window to define a string surface within said window, the string surface being disposed parallel to the plane of the thin planar rim.

17. For use as part of a racket having a primary frame that comprises an interior opening, a secondary frame sized to fit in the interior opening of the primary frame, said secondary frame comprising two similarly-shaped thin rims and being rigid with respect to inwardly directed forces in the planes of the rims, each rim having a thickness dimension that is much less than its width dimension, and a plurality of strings secured in required tension by the secondary frame and disposed within said window to define a string surface within said window, the ends of the strings that form the string surface being secured between the two rims in the form of a sandwich structure, means being provided to secure the two rims together.

* * * * *